US007392985B1

(12) United States Patent
Lam

(10) Patent No.: US 7,392,985 B1
(45) Date of Patent: Jul. 1, 2008

(54) RECEIVER MATRIX CONFIGURED TO IDENTIFY MULTIPLE EXTERNAL RESISTORS

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 593 days.

(21) Appl. No.: 10/638,706

(22) Filed: Aug. 11, 2003

Related U.S. Application Data

(63) Continuation-in-part of application No. 10/242,847, filed on Sep. 13, 2002, and a continuation-in-part of application No. 10/241,340, filed on Sep. 10, 2002, and a continuation-in-part of application No. 10/208,346, filed on Jul. 30, 2002.

(51) Int. Cl.
*A63F 3/00* (2006.01)

(52) U.S. Cl. ..... 273/238

(58) Field of Classification Search ..... 273/238; 702/57–59, 64–65, 118, 182–185; 700/73, 700/324

See application file for complete search history.

(56) References Cited

U.S. PATENT DOCUMENTS 3,481,604 A * 12/1969 Fan ..... 273/238
4,876,515 A * 10/1989 Ball ..... 324/538

* cited by examiner

*Primary Examiner*—Corbett Coburn

(57) ABSTRACT

An electronics circuit designed for a matrix array of receivers configured to detect multiple external resistors of close values selected from the 100 ohm to 1 Mohm range, and to provide different responses according to the resistance of a resistor connected to a receiver.

24 Claims, 11 Drawing Sheets

RECEIVER MATRIX CONFIGURED TO IDENTIFY MULTIPLE EXTERNAL RESISTORS

This is a Continuation In Part application of pending U.S. patent application Ser. Nos. 10/208,346 filed Jul. 30, 2002, 10/241,340 filed Sep. 10, 2002 and 10/242,847 filed Sep. 13, 2002.

FIELD OF THE INVENTION

The present invention relates to an electronics circuit comprising an array of receivers, each configured to identify an external resistor so as to provide different responses according to the resistance value measured.

BACKGROUND OF THE INVENTION

Traditional portable interactive learning toy for children provides a sensor pad positioned beneath a printed game card. The circuit of the sensor pad detects the position of a pen or by a finger by means of pressure, resistive, optical, capacitive or inductive changes. For many designs, the pen is required to be connected to the game console with a wire for the unit to receive the selection signal. The game play is defined by the pictorial content of the card designed according to an internal program or an external program represented by a game cartridge. This type of learning toy depends of "two dimensional" pictures illustrated on the pictorial card. The player is also required to make use of a pen or pressing with a finger to indicate the selected answer when a question is asked. According to a research of this invention, it was found that younger child likes to play with toys that are free to move around, rather than a pen connected with a wire or having to press hard with their tiny fingers. Pen is a tool that can only be handled by an older child. Besides, it was discovered that younger child tends to remember real life article than abstract expressions. In addition, younger child is more ready to learn from three-dimensional toys than to interpret the meanings of a two dimensional picture. It is the objective of this invention to provide an electronics circuit that enable a portable learning toy to replace the pen or finger pointing with real life three dimensional accessory toys free to move around. An embodiment of this electronics circuit makes use of the high resolution resistor recognition circuit that is capable to resolve resistor tolerance lower than 10%, preferably 5% as disclosed in applicant's pending application Ser. No. 10/227,708 which is the formal application of provisional application 60/316,643. Another characteristics of the invention is that a multiple dimensional receiver array is provided to handle multiple external resistors to be received by the toy play set as disclosed in parent patent application Ser. Nos. 10/208,346 filed Jul. 30, 2002.

SUMMARY OF THE INVENTION

The present invention is firstly directed to a hand held toy play set embodiment including a master toy unit and several groups of supporting or accessory toys. The master toy unit includes a power source; a processor or microcontroller; a program directing the processor to control the play pattern of the toy; an electrical to audio transducer such as a speaker to produce sound according to the play pattern; an array of receivers each provided with two contact terminals for interfacing with an external accessory toy article; a structure to receive an illustration card; a circuit to identify the card received; and possibly an array of push buttons for the child to select their choice of answer. Different groups of accessory toy articles are provided to support a game play. For example, multiple animal figures and a card illustrating a zoo are provided to support a game play teaching the child the knowledge of different animals. Another group of accessory toys is represented by a card illustrating a food store and a group of accessory toy members each represents a 3D food article. Other accessory groups may be provided to teach children about more abstract concepts such as color, shape, numbers and alphabets. Further families of action figures can be designed to build different interactive male action play sets.

An array of receivers is provided on a top-facing surface of the master toy unit. Each receiver is provided with two conductive contact terminals connected to the interfacing circuit located inside the master toy unit. The size of the receiver is to be carefully compromised. If the size of a receiver is too small, it will be difficult for a child to plug the accessory toy article onto the receiver. If the receiver size is too big, not much room will be left for providing illustration on the game card, which is to be placed on top of the receivers.

Illustrations on the game cards add color and fun to the game play. In the prior art embodiment, the game card is critical as it illustrates all the different choices of answers to be selected by the child. The child select an answer by pressing a pen or a finger down onto the two dimensional pictures illustrated on the card. Since the improved game pad enables the child to play with 3D accessory toys of real life shape, there is more freedom to design the illustrations and improve the play value of the toy set. For example, the game card can be printed with a short story, illustrated with words or pictures. Particular word location is replaced by a vacant space for the kid to fill in a proper accessory toy character. In this case, each of the vacant spaces of the card will be replaced by a hole adequate for an accessory toy member to make connection with the receiver located beneath the hole. It should be noted that the position of the hole should be properly aligned with the position of the receiver located beneath it. The theme of the card should be in line with the questions asked. For that reason, each game card is designated to work with a specific game program. Accordingly each card is provided an identifier for the processor to understand which card had been inserted into the master toy unit, and which game is to be played. Card identification can be provided by bar codes, magnetic strips or any other means that provides proper identification information to the processor.

Game programs in the form of digital codes may be stored inside the digital memory elements located inside the toy, or inside the game cartridges to be plugged into the master toy unit. External game cartridges enable the master toy unit to work with game to be launched at a later time. The digital memory elements, or memory means are represented by ROM (Read Only Memory), RAM (Random Access Memory), flash memory and any other type of digital data storage devices capable of providing digital data to the microcontroller of the master toy unit. The main function of the digital memory elements is to store the game program defining the game rules and scoring criteria, the voice/melody messages required to support the game play and to control the circuit, which identifies the identification element of an external accessory toy and also the scores achieved by each player. The digital memory elements, which may be part of the processor or microcontroller of the master toy unit, may also store data specific to the personality of each figure, or accessory toy member.

Different groups of accessory toy members are required to support different game themes. Each toy member should be provided an identity circuit capable of interfacing to the processor through the metal contacts located inside the receiver. Typical identity circuit is represented by an integrated circuit, a resistor, or other working passive component to provide identity information. Applicant's pending U.S. patent application Ser. Nos. 09/896,434; 10/118,706 and 60/324,202 disclosed circuits enabling a portable master toy unit to power up an IC located inside an external accessory toy through the two conductive contacts, and to retrieve audio and digital information stored inside the IC. Alternately the accessory toy member can be identified by a resistor of specific value installed inside the accessory toy member. The concept of using a resistor for identification purpose and a circuit capable to identify less than ten different resistor values was firstly introduced by the applicant in an ARCO Once Upon A Time Playset designed for Mattel Toys during April 1994. Applicant's U.S. patent application 60/316,643 and it's formal patent application pending application Ser. No. 10/227,708 disclosed more advanced circuits and IC designs capable of recognizing over 90 high resolution resistor identities. Since the commodity resistors are provided with 5% tolerance, it is reasonable to provide a circuit that can resolve 10% resistor value resolution.

Using IC for identification purpose is relatively expensive. Using resistors or capacitors for identification purpose is a cheaper solution but the number of possible identifications is comparatively limited. Another solution resulted during the research of this invention is to provide each group of accessory toys with a specific shaped foot print, or a foot print having a special shaped lock key. The holes of the game card for playing with the specific accessory group is also formed with the same shape of foot print of that group, such that accessory characters from another group is not allowed to make contact with the receivers of the master toy unit. In this way, the same group of resistor values can be repeatedly used for other different groups of accessory toy figures. It is also a requirement for the contact design of the receivers to be universal and independent of the shape of the accessory toy footprint. A convenient design is a concentric female socket similar in nature to the sockets for most small electronics products to connect with the power adaptors. When connectors in other shapes are used, the orientation of the socket is to be carefully positioned to be in line with the orientation of the specified footprint. The identity of each accessory toy member represents a unique personality that enables the game program to determine if the player provided a correct answer, so as for the play set to produce a proper audio and/or visual response. Audio responses are provided by converting an encoded audio signal stored inside the digital memory elements of the master toy unit, the game cartridge, or inside the IC located inside the accessory toy member. Visual responses can be achieved by providing power through the contacts terminals to a light bulb, LED or motor installed inside the main toy unit or an accessory toy member. Different data stores in the digital memory may be provided to offer different personalized audio/visual response for each accessory toy figure or member. As compared with the traditional prior art learning pads, the 3D learning pad disclosed enables the child to play with the individual accessory toy members, to feel it and to spend time and get more familiar with it. In addition, choice of answers from the 2D graphics printed on the game card is very limited for the traditional prior art learning pad, due to the size limitation of the game card. A manufacturer is now able to provide a much bigger number of accessory toy members for the child. It should be noted that when the game is targeted for the older kids, the 3D characters of the accessory toy members can be replaced by 2D photographs or pictures positioned on a podium structure of suitable footprint to reduce cost. From here it can be observed that the improved learning pad design provides more exciting audio/visual responses and incentives for the children to learn.

To add more complexity to the game play, an array of switches can be provided along the side of the game pad. These switches may be color coded, sign coded or letter coded for the child to enter an answer without using an accessory toy member. These switches are useful for selecting an answer not related with real life articles. Typical examples of these selections are taste such as sweet, bitter or sour; feeling such as happy, sleepy or anxious. When the switches are aligned in position with the receivers, special game plays can be designed allowing the child to interactively making use of both the accessory toy members and the side switches to play the game.

Once the target toy play set described above is identified, the next challenge is to provide electronics circuits that support the required function. It is an objective of the subject invention to provide a multiple dimensions array of receivers and measurement components to minimize the number of pins required from the microcontroller and the resistor detection circuit. The circuit is designed in a way to allow several resistors to be inserted into different receivers and stay in connection with the occupied receivers. It is also an objective of the subject invention to have every receiver be capable of resolving standard commercial resistor values of 5% tolerance. It is a further objective of the subject invention to have a "green" electronics circuit that consumes minimal operation power.

In order to conserve battery power, the resistor identification circuit and the microcontroller of the main toy unit should be kept at a low power standby mode, which consumes zero or negligible current, when the toy is not in use. As soon as an external resistor is received by any receiver, the processor or microcontroller of the main toy unit wakes up and transformed into a higher current active mode, starting a process to identify the value of the external resistor and then provides audio, visual and logical responses according to the play pattern. If the toy is not activated for a predetermined time, the internal program of the toy will turn the unit back into the low current standby mode.

In a first embodiment of the invention, two groups of I/O (input/output) pins, or interface pins are provided by a microcontroller and arranged in a X and Y matrix format. By definition, an I/O or interface pin of a microcontroller includes but not limited to all different kinds of input sensing pins, output driving pins, programmable input and output pins, open drain or open source pins and pins capable of providing high impedance.

A first contact point connected to any of the X row of I/O pin and a second contact point connected any of the Y column of I/O pin is arranged to form a receiver. Accordingly, a matrix of "m" rows and "n" columns provides a total of "m×n" receivers. When a resistor is receive by a receiver connected to the number "i" I/O pin and the number "j" I/O pin, the circuit will wake up and transform from a low standby current mode into a higher current active mode to start identifying the resistance of the external resistor. The microcontroller then provides a preprogrammed response according to the resistance measured. For example, a 100 ohm resistor representing a frog of the toy play set previously described will initiate the master toy unit to produce a frog sound. When a 270 kohm resistor represents a bird is detected, a bird sound is generated. The responses produced are not limited to sounds, the microcontroller may turn on light bulb or LED to provide illuminated responses. It may provide graphic responses on display devices such as LCD display panel or TV screen.

Alternately motion responses may be achieved by turning on a motor to provide animation effects.

As compared with A/D converter, a simpler method to identify the value of a resistor is obtained by measuring the charging or discharging characteristics of a capacitor in conjunction with a resistor. For the artisan skill in the art, the product of the values represented by a capacitor and a resistor forms a "RC" time constant. Given a known value of the capacitor and measure this time constant, the value of the resistor can be obtained. Accordingly a known capacitor is added to every column I/O pin of the circuit. The charging or discharging time of the RC pair is then measured to determine the unknown resistor value. In actual circuit design, it is not necessary for the full range of RC charging or discharging curve to be measured. In order to simplify the circuit design and save the cost of a voltage comparator circuit, the threshold voltage of an I/O pin can be used to determine the relative charging and discharging time of a RC circuit. Whenever a discharge timing is to be measured, the circuit needs to charge up the capacitor first. Therefore a rapid charging circuit, such as driving I/O pins is provided. An alternate method to charge up all the capacitors at one time is to provide a current source, either represented by a separated output pin, or represented by other current sourcing circuit such as a switched transistor. The current source is then connected to each of all the column pins. A diode is provided between a single current source and multiple column capacitors to prevent the capacitors being shorted circuit by the current source.

Enlisted below are the standard commercial resistor values:

Ohm range (discarding resistance value below 100 ohm): 100, 110, 120, 130, 150, 180, 200, 220, 240, 270, 300, 330, 360, 390, 430, 470, 510, 560, 620, 680, 750, 820, 910; total 24 different values. The k-ohm range is obtained by multiplying the above resistance values by 10 to provide another 24 different resistor values. The 10 k-ohm range is obtained by multiplying the above range of resistor values by 100 to provide an additional resistor values. The 100 k-ohm range resistor values is again obtained by multiplying the above resistor values by 1000 to provide further 24 resistor values. The total number of commercially available resistor values in between 100 ohm to 1M ohm is $[(24\times4)+1]=97$. It means the high precision circuit provided by the subject invention is able to identify 97 different identity articles making use of a single commercial standard resistor in each article. If two resistors are provided in each article for identification detection (requires three to four contact points), the total number of combination is $97\times97=9{,}409$, which is more than enough for most applications. It should be noted that among the 97 resistor values identified, some of the resistor values are less popular and can be considered as a secondary standard resistor value. Examples of these values are 130 ohm, and 240 ohm. Since all these standard resistor values carry a 5% tolerance, it is essential to have a high precision circuit capable to resolve the roughly 10% value separation in between two adjacent resistor standard values. Since an upper margin resistor may have a value almost identical to the lower margin resistor of the next value, it may be required in the production process to sort out the marginal resistors so that their values will not overlap.

The tolerance of commercial capacitors is higher than that of the resistors. Typical value tolerance is 10% or higher for commodity capacitors. This tolerance may also vary from time to time due to chemical aging of the capacitor or poor temperature coefficient of the capacitor design. Therefore the reading circuit is preferred to be equipped with a calibration circuit. An example of the calibration circuit is to include a high tolerance resistor, say a 1% resistor of known value into the circuit. The microcontroller measures the time constant of the reference capacitors with this reference resistor to precisely determine the value of a reference capacitor before it starts to measure the value of an external resistor.

Another difficulty encountered during the invention process is that there are many different kinds of commercial capacitors, each carry different characteristics due to different structure and dielectric material used. As a result, the value span of each type of capacitor is very limited. For example, commercial ceramic capacitors provide capacitance range from nanofarad to 0.2 microfarad. Commercial electrolytic capacitors provide a range from 0.1 microfarad to several thousand micro farad. The range of Tantalum capacitors is close to that of electrolytic capacitors but within a narrower range. It is beyond the resolution capability of the time measurement circuit of a microcontroller for a single capacitor to service the wide range of resistance values from 100 ohm to 1 Mohm. As a result, it is desirable to provide different type of capacitors in the same charging or discharging measurement circuit. That is to connect multiple capacitors to the column I/O pin as described above. In addition to the two dimensional switching circuit between the I/O pins of the X and Y array, a third dimension, or group of I/O pins is required to determine which capacitor is to be connected. If an external resistor failed to provide a reasonable reading with one capacitor, the third dimension I/O circuit will be switched to connect another capacitor for another round of charging or discharging time measurement. Depends on the circuit arrangement, a diode may also be connected in series with each capacitor to prevent the capacitance of one column to be coupled into another column.

Since each group of capacitors is able to service only a limited range of resistance values, every group of capacitors requires a different calibration resistance. Accordingly, reference resistors of different values are provided and a fourth dimension, or groups of switched I/O pins is required by the circuit to determine which reference resistor is to be turned on during the calibration process. Depends on the circuit arrangement, diodes may be connected in series with a reference resistor to prevent the calibration circuit to be short circuited.

Whenever an external resistor is received between a row pin and a column pin, a resistance is formed in between these two pins. If multiple resistors are received, the resistance reading between a row pin and a column pin will not truly represent the actual resistance of the external resistor because of the presence of other external resistors. Accordingly, a diode is required to be connected in series with every external resistor to provide a true reading.

According to another embodiment, a proprietary IC is designed to simplify the capacitor array of the RC circuit. Instead of providing different arrays of capacitors of the same value in the circuit, only one capacitor is provided to service each resistor range. Whenever the presence of an external resistor is detected, the proprietary microcontroller provides an internal switching circuit to the capacitor and carry out the RC measurement process. The number of calibration reference resistors is also reduced as a result.

Instead of using a RC charging and discharging circuit, other properly designed circuit can be utilized to service the two-dimensional receiver array if properly designed. Another circuit disclosed in the parent application can also be modified to measure resistance array formed in X and Y matrix format. An array of internal gates, each carries a different resistance value is connected in parallel or in series with the external resistor to form a potential divider. The value of the external resistor is then detected by measuring the voltage of this potential divider. Alternately an array of gated resistance is switched until the resulting voltage of the voltage divider hits a threshold voltage. A/D converter may also be utilized to measure the voltage formed by the voltage divider. In order to resolve the wide range of resistance values as previously discussed, multiple measurement circuits, each dedicated to a different range of resistance are provided. Arrays of switches are provided inside the microcontroller to connect the external resistor to the different measurement circuits. Internal array of switches may also be required to connect the array of different external reference resistors for calibrating these different measurement circuits.

The multiple dimensions circuit structured for measuring different external resistors connected to a matrix of receivers at the same time can be extended to microcontrollers supported with multiple D/A converters. One of the built in D/A converter is configured to generated sounds for supporting the game play. The other embedded D/A converter is configured to provide controlled feedback voltage or signal for successively comparing with the voltage formed by the external resistor and an array of reference resistors. The comparator can be provided outside the microcontroller or embedded inside the microcontroller. Voltage comparing circuit and operational amplifier may be use to service the function of a comparator. When a comparator is provided outside the microcontroller, a power controlling circuit is preferably to be developed for the power consumption of the external comparator to be controlled according to the flow chart of the of the game play.

It should be noted that all the resulted electronics circuits developed to supported the target toy is not limited to the application of the target toys described. It is the intention of this patent application to have the invented electronics circuit designed to service all other innovative applications that are benefited from the novel features of the invented circuit design. The shape of the master toy member and accessory toy members can be modified without significantly changing the internal circuit design to provide completely different toy play sets, according to the different creative play pattern and game rules developed.

In another preferred embodiment, the master toy member is provided in the shape of a platform and each accessory toy member represents a toy figure of different background and personality. When the user connected a toy figure with the master toy platform, the internal resistor of the toy figure is identified and the background information such as the name, age and hobby of the toy figure is announced. After different toy figures are lined up on the platform, the master toy member starts to ask questions about the toy figures. Scores are given to the users who memorize the background information of each toy figure and provides the correct answers. The master toy member may also gives commands to alternate the sequence of figures line up, or to exchange one figure with another one not on the platform. This toy play set provides an excellent game to train the children to memorize information about different people.

In another preferred embodiment, the master toy member is decorated as a car racing field and each accessory toy member is a racing car or motor vehicle of different characteristics. The master toy member announces different type of racing environments such as off road and drag race, before rounds of racing start. The users selected different racing cars to participate in the different rounds of racing. The master toy unit identifies the nature of each car on the racetrack according to the internal resistor detected. After pressing the race button, exciting racing sound effects are provided. The winning car is then announced according to the background characteristics of the racing cars detected and nature of the racing ground previously announced. The power and capability of a racing car can be upgraded or downgraded according to special upgrade equipment added and the maintenance effort provided. The microcontroller programmed with suitable game rules defines the interactive play pattern as well as the criteria for an accessory toy member to be upgraded or downgraded. The winner is the player who takes best care of his/her fleet of racing cars and also provides the best racing strategy—to assign the optimal racing cars for racing against the selected cars of the opponents under different racing fields environments. The value of the game greatly depends on the creativity of the game rule. Usually game rule are to be carefully designed to enhance the playing value of the game. For example, if the racing car game rule defines that the capability of a racing car will be exponentially decreased with continuous rounds of racing, the best equipped car will then be preferred to be use in only the most important round of racing competition. The user will then be forced to carefully plan for the sequence of assigning different racing cars in different rounds of racing.

In yet another preferred embodiment, the master toy member is decorated as a male action toy battleground. The accessory toys are in the shape of male action toy figures, each comes with unique strength and weakness. The master toy member identifies an action toy figures when it joins the battleground. The power of a figure may be upgraded or downgraded according to predefined game rule such as training or combat experience. Teams of toy figures battle against each other when a combat button is pushed. The victory belongs to the side that best remembered the characteristics of each toy figure and provided the best combating strategy.

In another application of the invented technology, the master toy member becomes the game board of a board game such as a chess set. The accessory toy units are decorated in the shape of different chess members each having an unique internal identity component. The play pattern is defined by the rules of a chess game.

The novel features of the invention are set forth with particularity in the appended claims. The invention will best be understood from the following description, when read in conjunction with the accompanying drawings.

DETAILED DESCRIPTION

Figure 1:
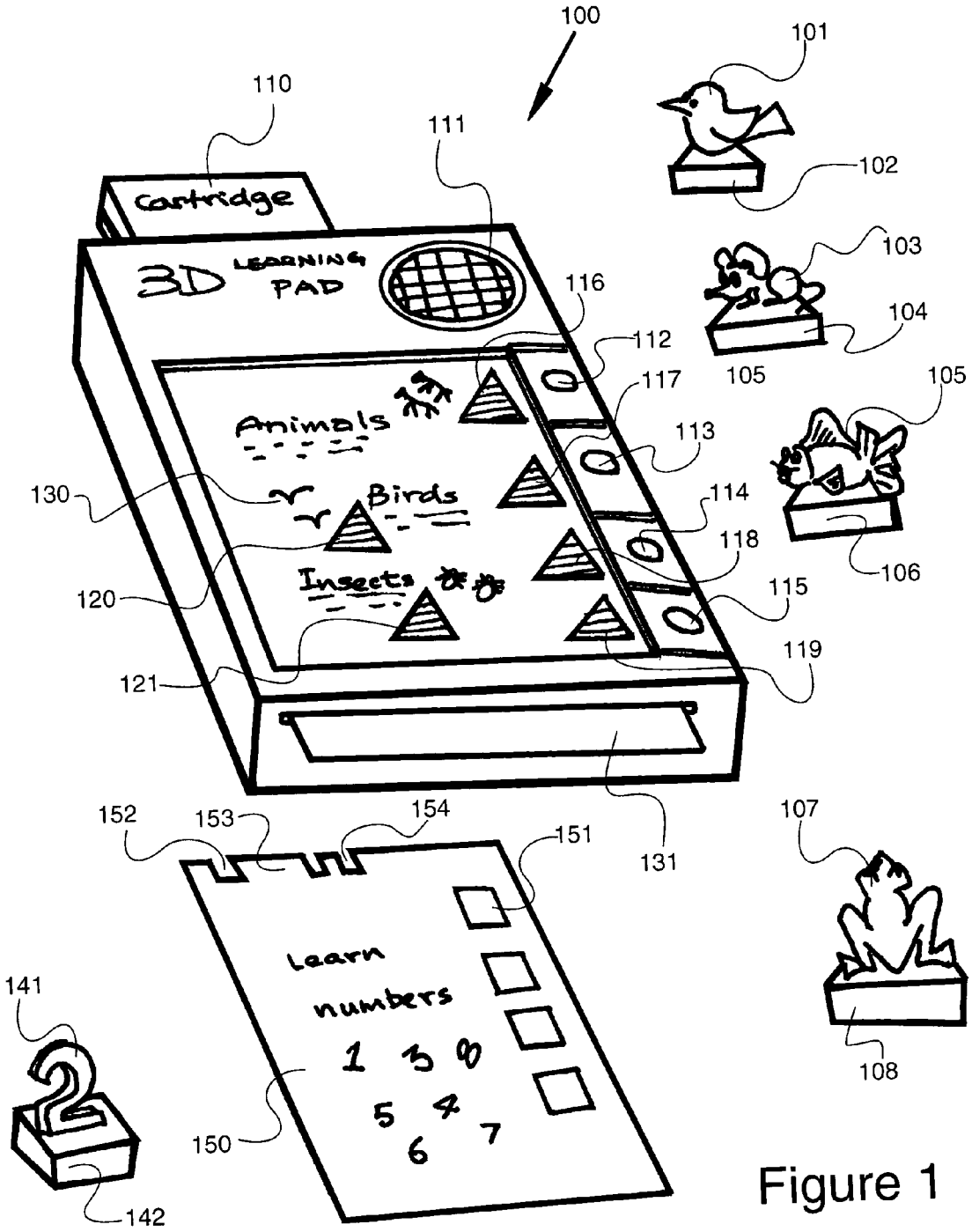
FIG. 1 illustrates the embodiment of a learning pad play set interacting with external 3D accessories each represented by a different resistor.

Attention is initially directed to FIG. 1, which depicts the combined application of a master toy embodiment 100 and multiple accessory toy members 101, 103, 105, 107 and 141. The master toy unit 100 comprises of a game cartridge 110; the speaker 111, a game card 131 and a line up of side switches 112 to 115. Inside the cartridge 110 are memory devices that stores a program to direct the game play. The game card 131 is provided with triangular holes 116 to 119 and 120, 121. Underneath these triangular holes are receivers structured to receive an external accessory toy member represented by the three dimension characters 101, 103, 105 and 107. Each of the receivers is provided with two contact terminals configured to make contact with the circuit of the accessory toy members when they are received by any of the receivers. An array of receivers is located at the panel beneath the game card 131. The game cards 131 and 150 are carefully designed such that the positions of each holes 116 to 119, 120, 121 and 151 is properly aligned with the location of a receiver. Inside each 3D accessory toy members is an identifier circuit, a voice generating circuit, a light bulb, a LED or a motor. In an example of a game play, the processor derived a message, instruction or question from the game cartridge and ask: "Find the mouse and place it on the first line!". If the child picks the fish 105 for the receiver 116, another message will be announced to ask the child to try again. If the mouse 103 is selected for the receiver 116, the child is praised for the correct answer selected. Once the receivers 116 to 119 are correctly filled, the master toy unit may ask further question about the game play. A further example question is "Please select an animal that is able to fly!". The correct answer is to select the button 113 by the side of the receiver 117 that accommodated the bird 101. It should be noted that all the accessory toy members 101, 103 105 and 107 belong to the same group that works with the game card 131. These accessory toy members are characterized by a triangular shape footprint. Game card 150 works with another group of 3D characters. Since the theme of the game card 150 is to learn numbers, all the accessory toy members are represented by 2D or 3D shapes of numbers exemplified by the toy member 141. It should be noted that the shape of the hole on the card 150 is designed to match with the footprint of the toy member 141. They are all of the same size square shape. In addition to the different shape of footprint required to identify the groups of accessory toy characters to be used, the master toy unit is designed to identify which game card was inserted. This can be achieved by providing an identifier to each of the game card, such as bar code and magnetic stripe, or by any other way to inform the microcontroller the nature of the card inserted. The slots 152, 154 and covered area 153 is designed for an optical or mechanical reader to detect the identity of the game card 150. Additional game cards and game cartridges may be provided to enrich game play. Different games should be supported with matched cartridge, game cards and the appropriate group of accessory characters.

Figure 2:
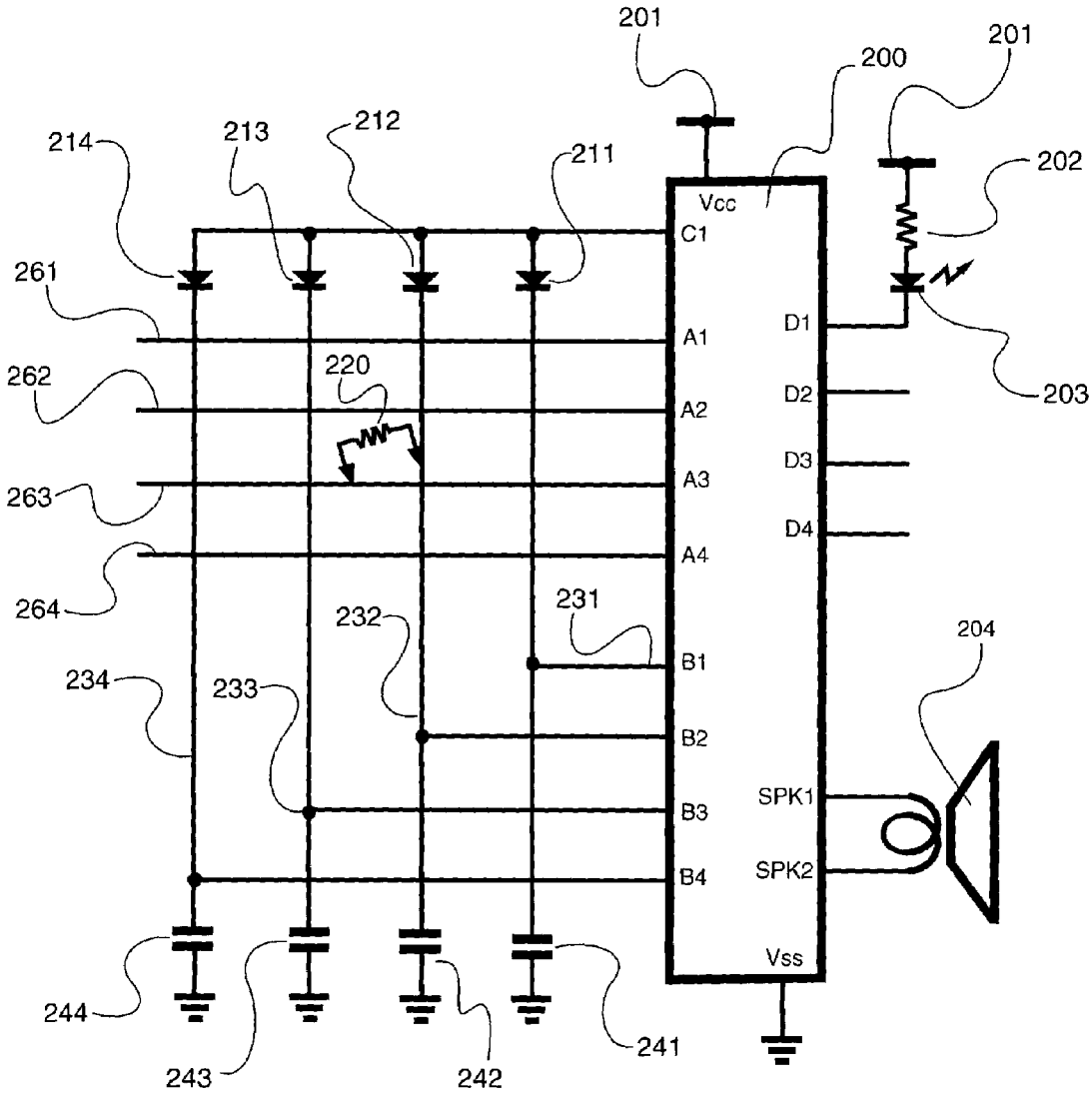
FIG. 2 illustrates an embodiment of the electronics circuit designed for the play set of FIG. 1.

Attention is now directed to FIG. 2, which illustrates the circuit design to support the toy play set of FIG. 1. The microcontroller 200 provides a first group of I/O pins A1 to A4 to form the rows of a receiver matrix and a second group of I/O pins B1 to B4 to form the columns of the receiver matrix. An array of capacitors 241 to 244 are connected to each column pin of the circuit. A receiver is formed by two contact points, one connected to a row pin and the second one connected to a column pin. Accordingly the 4×4 matrix provides 16 receivers. The contact points of the receiver is configured to make contact with a resistor embedded inside an external article. For example, when an external bird shape article or toy figure comprising the resistor 220 is connected across row A3 and column B2, the circuit measures the resistance of the resistor and initiates a proper response such as producing a song sing by a bird. As in the example of FIG. 1, when the microcontroller 200 detects a 100 ohm resistor representing the frog 107, it provides a response represented by a frog sound generated through the speaker 204. If a 560 kohm resistor representing the fish 106 is detected, the microcontroller 200 turns on the blue LED 203 which light up an aquarium shown on a play card. To identify the resistor 220, the microcontroller momentarily sets the pin C1 to high, this action charge up the capacitor 242 through the diode 212. Then the B2 is set to input mode and pin A3 is set from high impedance to low. The capacitor will start to discharge through external resistor 220. The signal obtained from pin B2 is monitored and the time required by the signal to turn from logic high to logic low is measured. The measured discharge timing is then compared with a predefined table which indicates the resistance of the external resistor, or the nature of the accessory toy figure it represents. The identification result directs the microcontroller to provide different responses according to the timing or resistance value detected. It should be noted that if the output current provided by the pin C1 is limited, the pin C1 can be connected to turn on a higher power current source such as a transistor current driver to speed up the initial charge up time.

Figure 3:
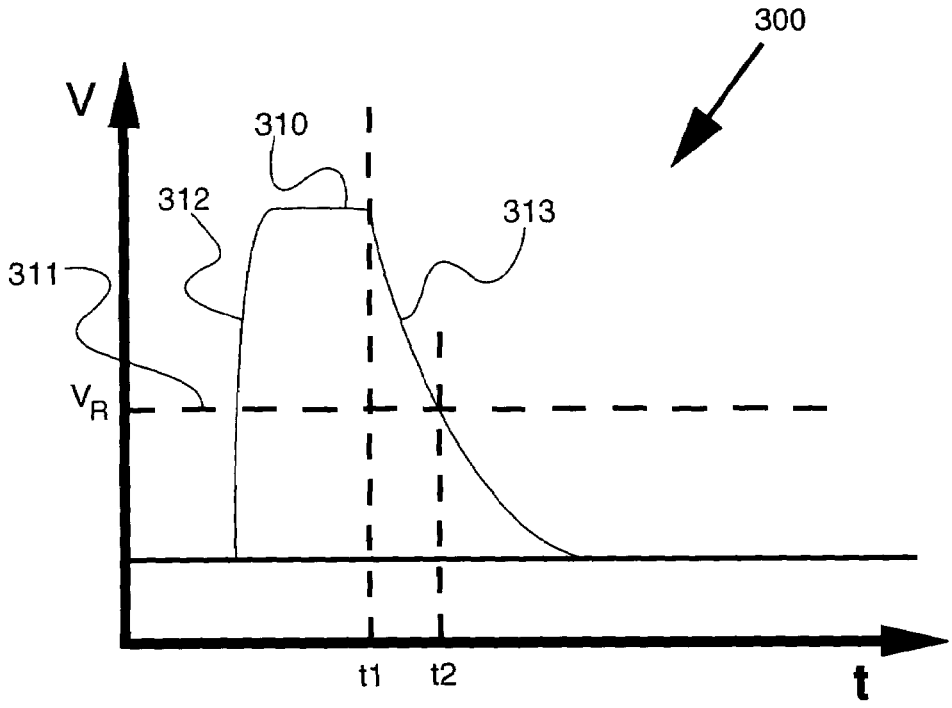
FIG. 3 discloses the waveform to measure a resistor by a discharge curve.
Figure 4:
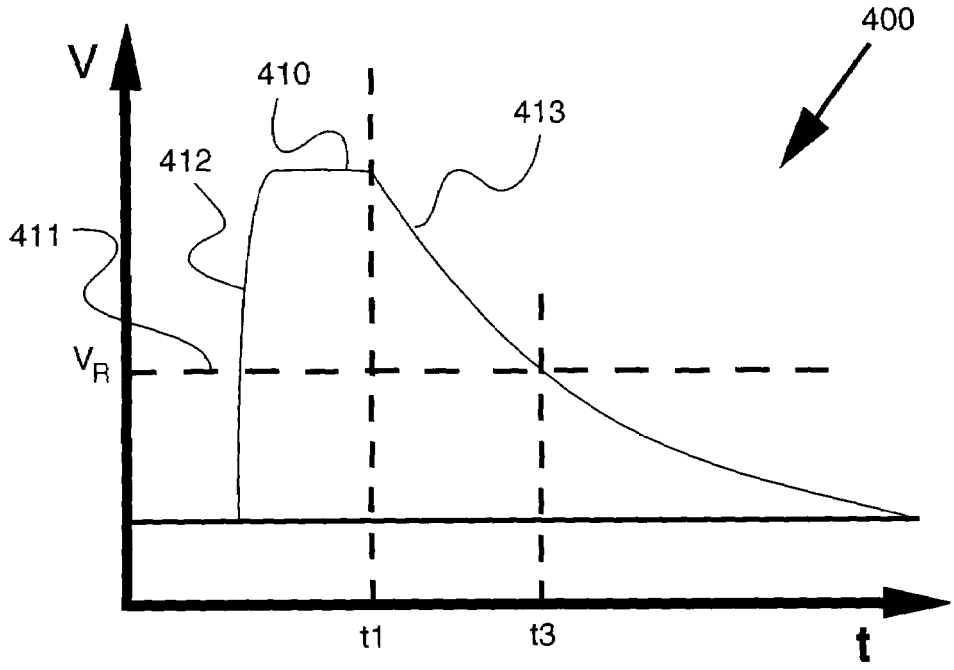
FIG. 4 illustrated the change of discharge curve of FIG. 3 when a higher resistance is connected to the RC measurement circuit.

Attention is now directed to FIG. 3, which illustrates the waveform received by pin B2 during the measurement process. When pin C1 is set high, the voltage received by pin B2 is represented by the charge up curve 312 that levels off at 310, the high voltage level of pin C1 subtracted by the voltage drop of the diode 212. At the moment t1, pin C1 and A3 are set low and the capacitor 242 starts to discharge through the external resistor 220. When the discharging voltage drops to a threshold level 311, the logic level received by pin B2 changes from logic high to logic low and the time t2 is recorded. The timing between t2 and t1 represents the resistance value of the external resistor 220. FIG. 4 represents the discharge curve when the resistor 220 is of a higher resistance value. The discharge curve 413 takes a longer time to reach the threshold level 411. The time in between t3 and t1 therefore reflects the higher resistance value of the resistor 220 and directs the microcontroller to provide another response according to the program directing the microcontroller. It should be noted that the programs that control the measurement process, directing the table look up process to provide the responses and the data that represents the sound generated by the speaker 204 of FIG. 2 can be stored in different kinds of memory devices, either embedded inside the microcontroller 200 or located outside the microcontroller 200.

Figure 5:
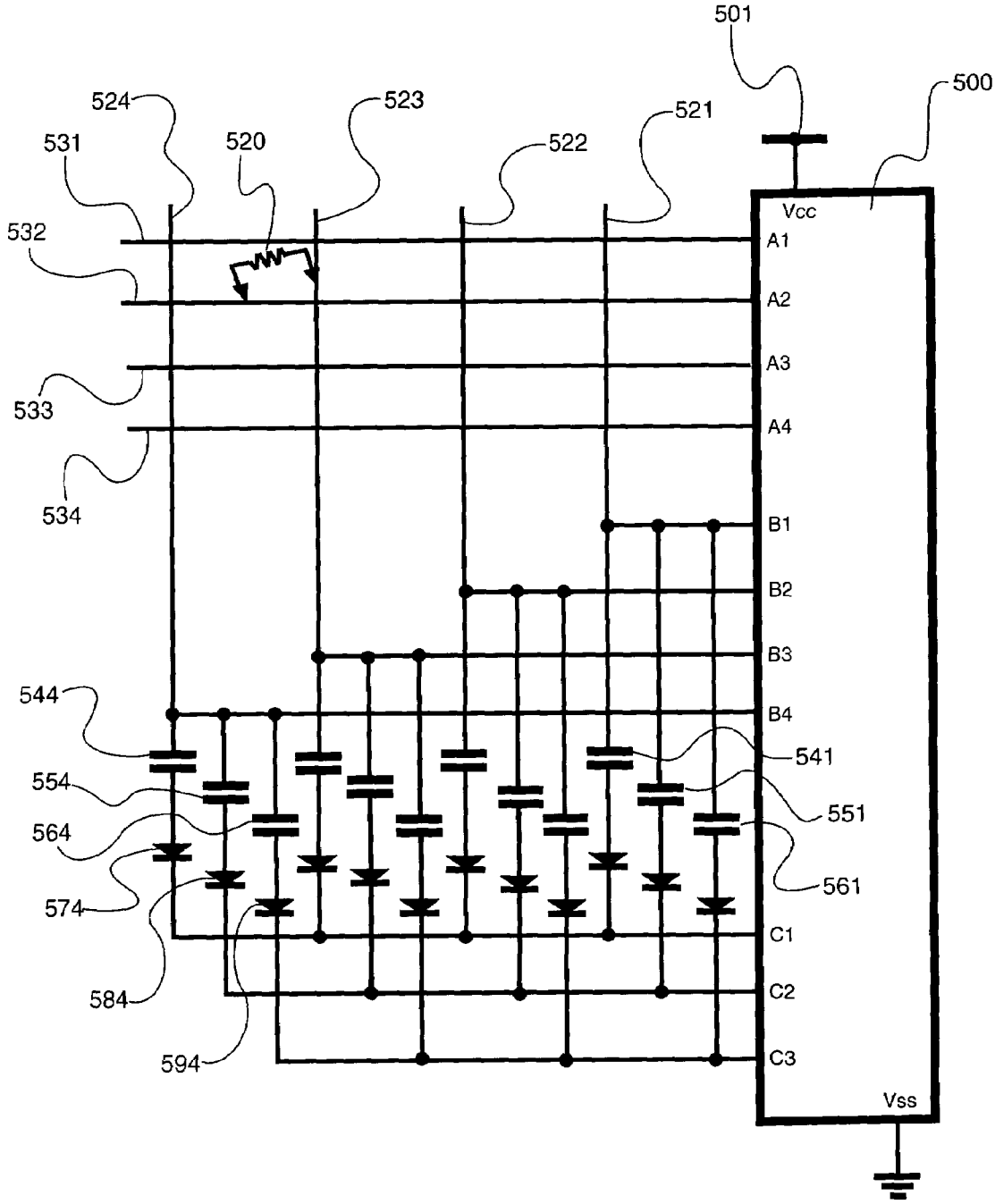
FIG. 5 is a circuit providing multiple groups of reference capacitors to service different ranges of external resistors.

FIG. 5 illustrates an improvement of the electronics circuit shown in FIG. 2. Each column pin is connected to more than one capacitors, each of different value to handle external resistors of different resistance ranges. For example, the capacitor 541 is 470 uF, which is suitable to work with the low resistance range from 100 ohm to 1 kohm. Capacitor 551 can be selected around 4.7 uF for it to work with resistance range of 1 kohm to 10 kohm. Capacitor 561 can be of a further lower value for it to work with higher resistance ranges. Tantalum capacitors are preferred choice for the low micro farad range due to the smaller size and good stability. Electrolytic capacitors are more commonly available for the higher microfarad range. For capacitance below 0.2 uF, ceramic capacitors can be selected. There are other different kinds of monolithic, mylar and film capacitors, each offer good performance at different capacitance ranges. Because of the wide range of resistance ranges to be serviced, capacitors made with different material or process are required to be connected with the same column pin for servicing different resistance ranges. The microcontroller 500 provides a third group of I/O pins C1 to C3 to determine which discharging capacitor is to be connected with the receivers. Diodes 574, 584 and 594 are connected in series to each capacitor so that the reference capacitors 541 to 564 will not be bridged by multiple resistors connected at different locations of the receiver matrix represented by the columns 521 to 524 and rows 531 to 534. If the I/O pins B1 to B4 are programmable I/O lines, the charging process can be provided by first settling the corresponding B1 to B4 lines to output mode with high logic to charge up the reference capacitor and then return the lines to high impedance input mode to monitor the discharge curve. In the embodiment of FIG. 5, after power up initialization, the pins A1 to A4 can be configured at logic high level. The pins B1 to B4 are configured as input pins that normally stay at a logic low pull down level. Interrupt function is provided to each of the B1 to B4 pins. Pins C1 to C3 are configured to stay at a high impedance mode. The chip is now in a low standby current mode ready to receive external resistors. When a resistor is connected to a receiver across one of the row pins and one of the column pins, the interrupt function wakes up the microcontroller into a higher current active mode. The row and column pins then perform a scanning routine by pulsing the A1 to A4 lines and reading the B1 to B4 lines to identify which pair of pins had been accessed. When the location of the external resistor is identified, the corresponding C1 to C3 lines are turned to low level for performing the charging and discharging measurement function.

Figure 6:
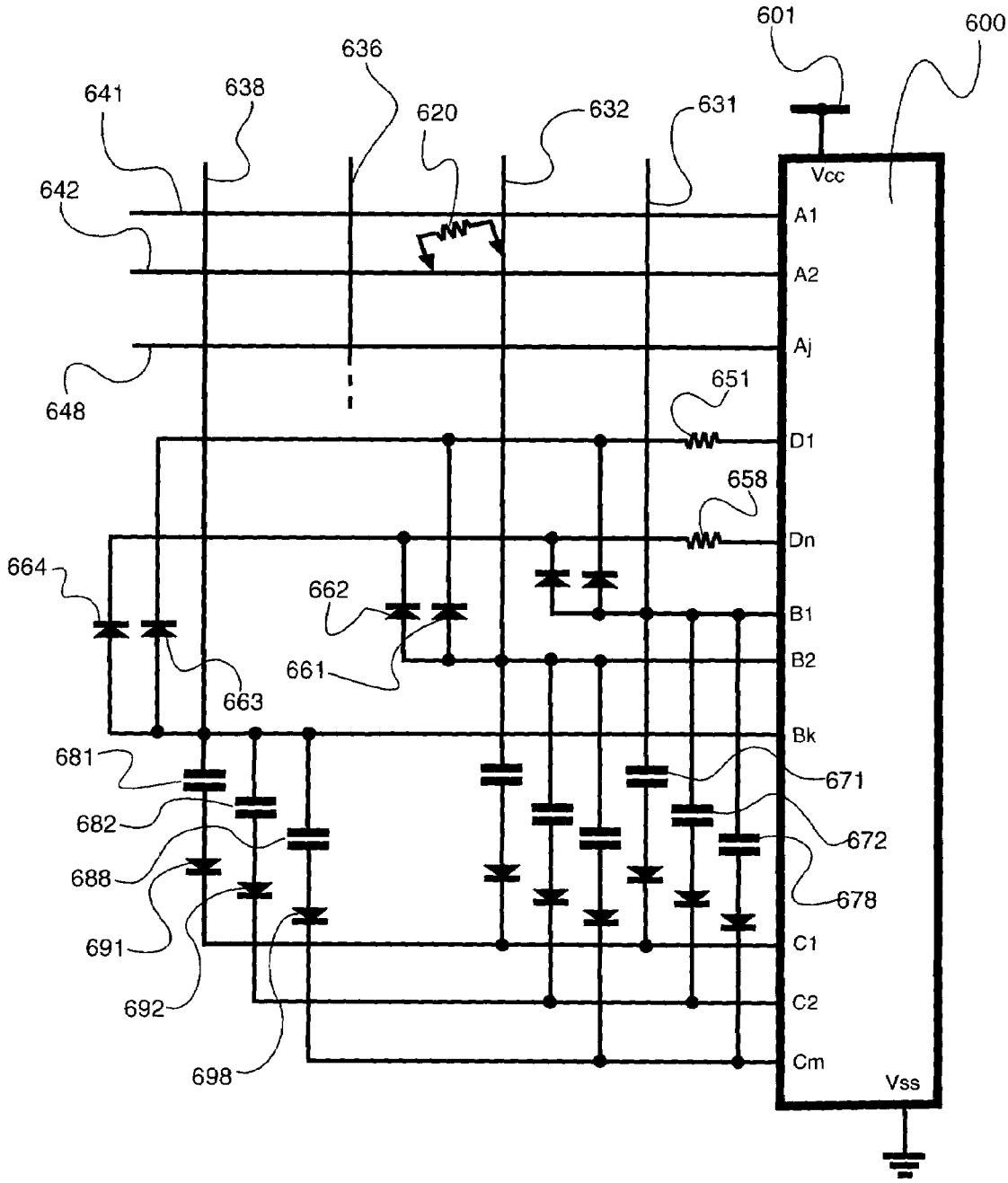
FIG. 6 is an improvement of the circuit of FIG. 5 to provide calibration function.

Many capacitors are not perfect for timing control applications. Electrolytic capacitors deteriorate overtime. Internal impedance, leakage current and capacitance may change after aging or repeated use. Many other capacitors change in capacitance values when the temperature of the working environment changes. Accordingly it is desirable to provide a calibration process before the actual measurement process is performed. FIG. 6 illustrates an example of the calibration circuit. High precision resistors 651 to 658 are connected to the column circuit to perform controlled discharging of the reference capacitors 671 to 688. The variation of each capacitor 671 to 688 is then taken into account or a compensation factor is provided for each capacitors before the resistance of the external resistor 620 is measured. The tolerance of the reference resistors 651 to 658 are preferred to be of higher tolerance, say 1%, to achieve better calibration result.

Figure 7:
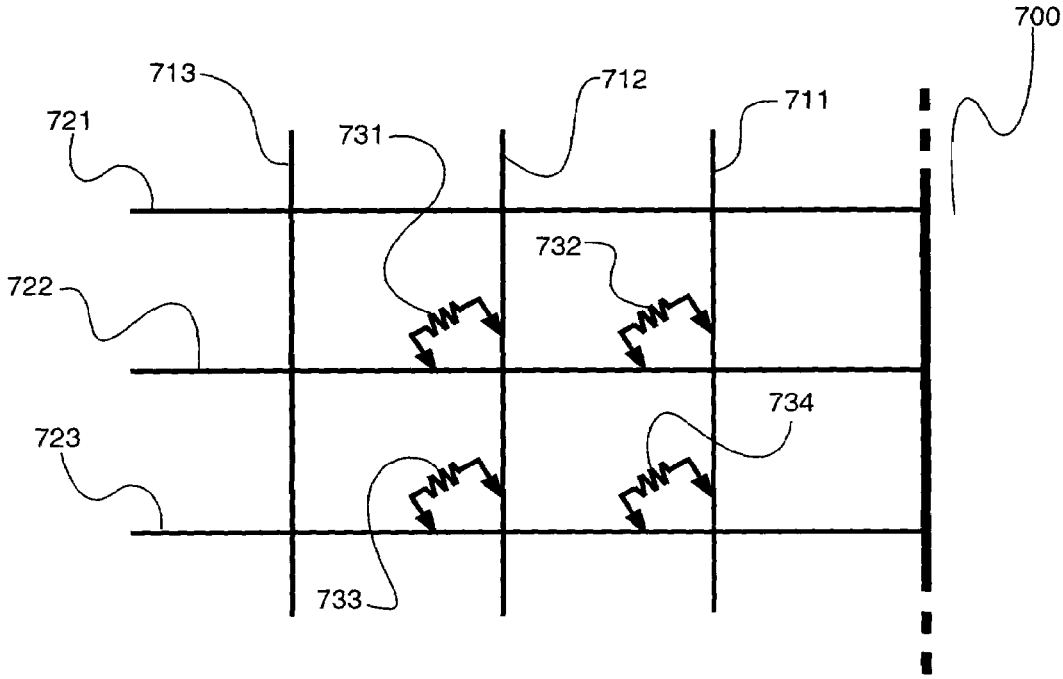
FIG. 7 illustrates the condition when multiple external resistors are connected to the receiver arrays.
Figure 8:
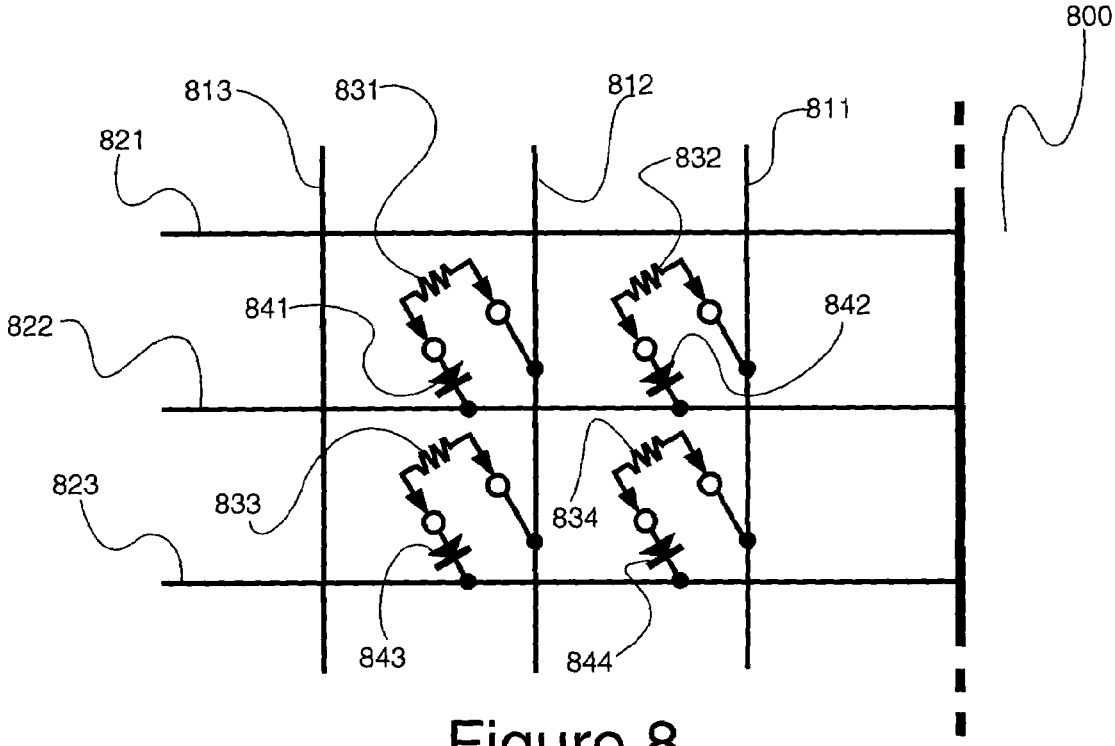
FIG. 8 illustrated improved design of the electronics circuit illustrated in FIG. 7.

FIG. 7 provides an environment when multiple external resistors are connected to the receiver matrix. Assuming resistors 732, 733 and 734 are the external resistors previous received and stayed connected with the receivers shown, it can be observed that when the external resistor 731 is connected with the receiver defined by column 712 and row 722, the actual resistance measured between the receiver of 731 equals to the resistance value of 731 in parallel to another resistor equivalent to 732 to 734 connected in series. To prevent this effect, a diode is connected to each receiver as illustrated in FIG. 8. Assuming the current flows through the resistor 831 is flowing from the line 812 to the line 822, the current path flowing through resistors 833, 834 then to 832 is blocked by the reverse polarity of the diode 844. Accordingly proper measurement of the resistor 831 will not be affected by the pre-existence of the resistors 832, 833 and 834. It is the goal of the invented circuit design to allow several external resistors to be received by the receivers at the same time.

Figure 9:
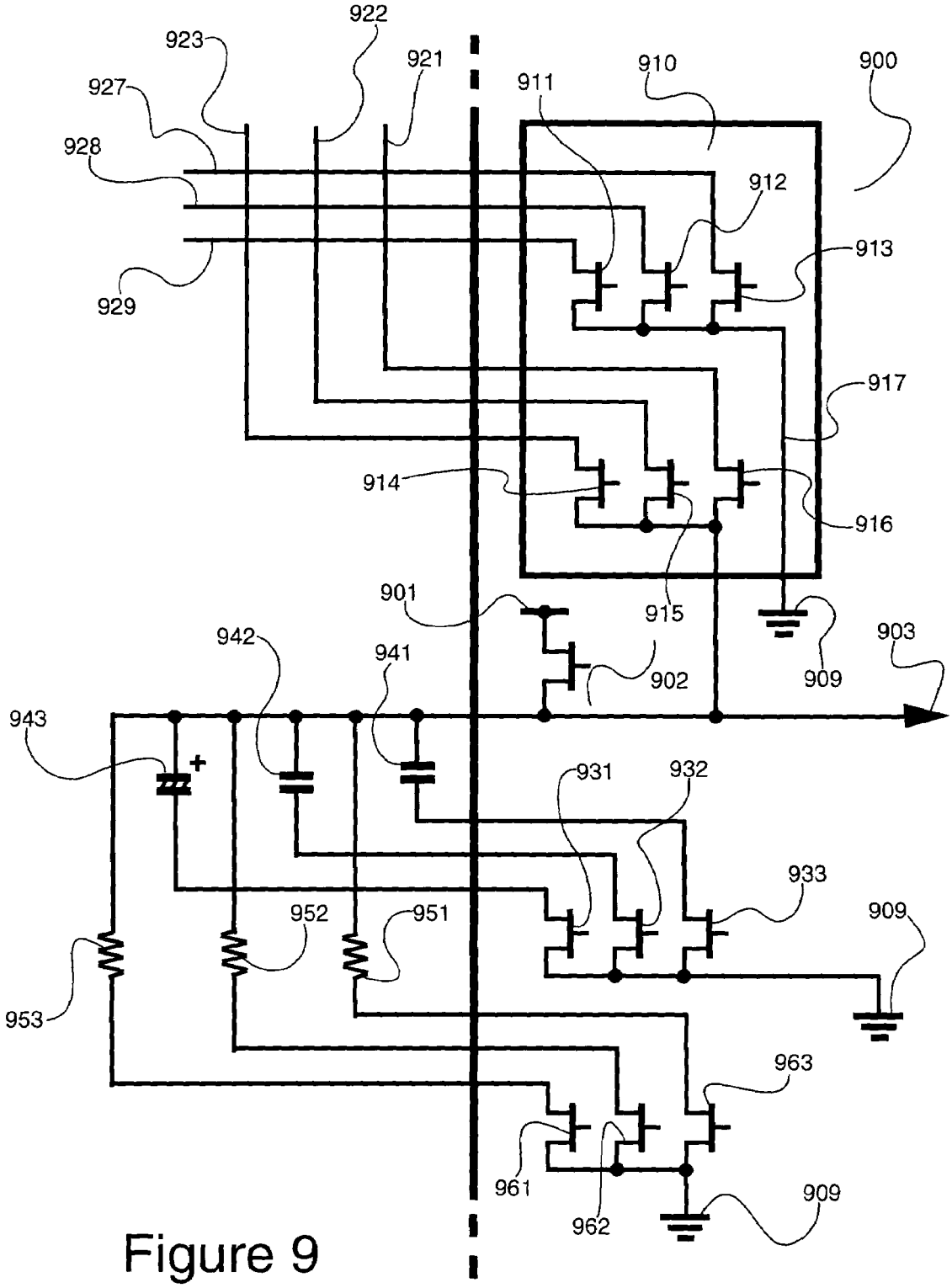
FIG. 9 illustrates the arrangement of a proprietary integrated circuit requiring only one reference capacitor to service one range of external resistors and the simplified calibration circuit resulted.

Attention is now direct to FIG. 9, which illustrates a simplified circuit of FIG. 6, which make use of a generic microcontroller 600. This circuit requires a custom made microcontroller IC 900. Only one array of reference capacitors 941 to 943, each of different value, and probably of different materials are required to be shared by all the receivers. The gates 931 to 933 select one of the capacitors 941 to 943 for performing the measurement function. The gate 901 charges up one of the capacitors 941 to 943 selected. The gates 961 to 963 then select the corresponding reference resistor 951 to 953 and perform a calibration procedure. Then the gate 901 is turned on again to recharge the selected capacitor. Gates 911 to 913 and 914 to 916 determine which receiver is to be measured. The discharge voltage is monitored by a sensing circuit receiving the discharge signal from the path 903. The teaching of FIG. 9 is directed to multiple resistance measurement circuit to be shared by all the members of the receiver matrix. Although only discharge capacitors of different nature is illustrated in FIG. 9, the same principle is extended to other different kinds of resistance measurement circuits such as A/D converters or successive switch and compare circuits whereby multiple measurement circuits are shared by a matrix of receivers.

Figure 10:
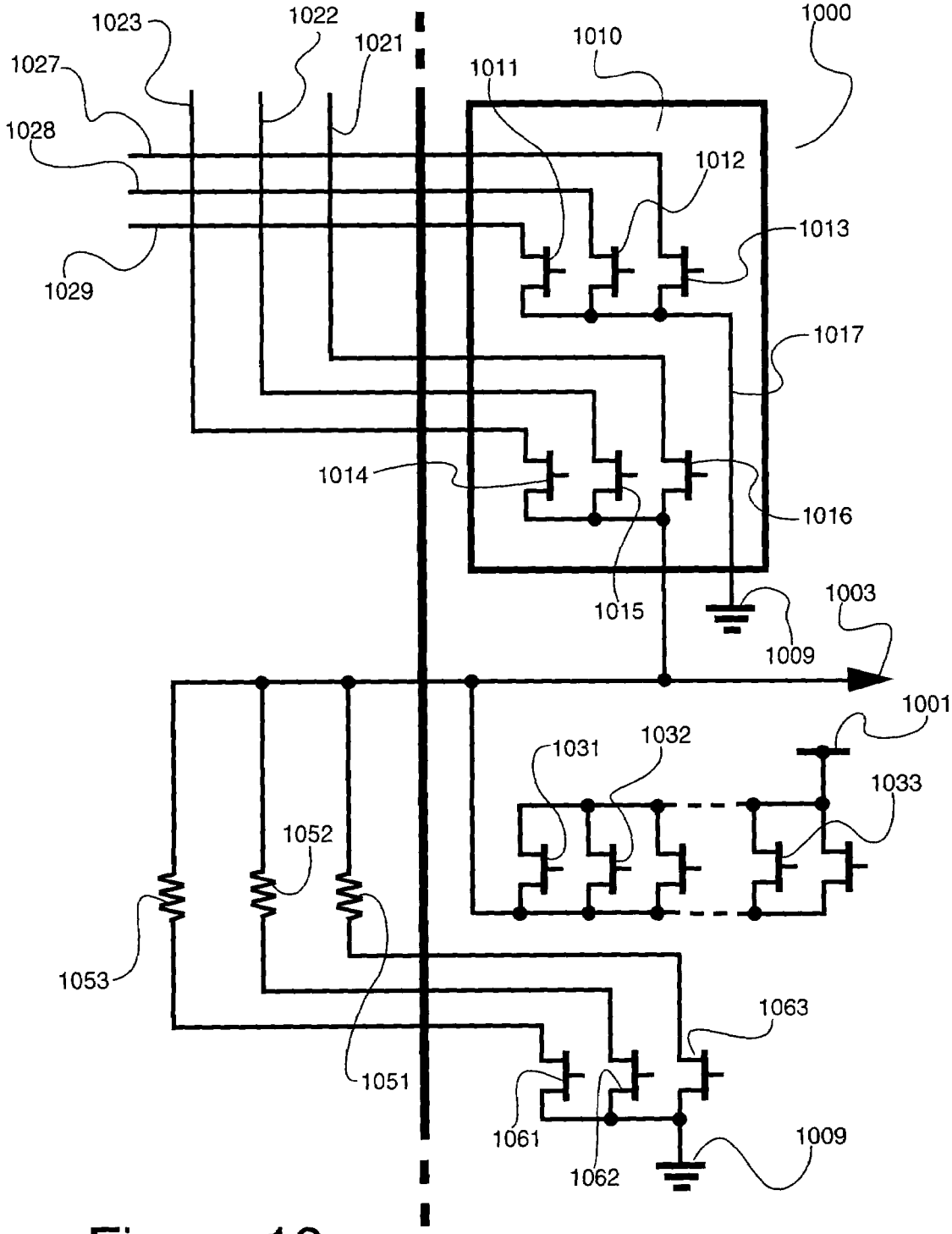
FIG. 10 illustrates alternate circuit design to measure multiple external resistors without using a RC measurement.

FIG. 10 illustrates modification of the electronics circuit of FIG. 9 by replacing the RC discharge circuit with the successive switch and compare IC design disclosed in the parent patent application of the subject invention. The RC discharge circuit of FIG. 9 is replaced by one or more arrays of switched resistors represented by the gates 1031 to 1033. Each element of these gates, when turned on, provides a different resistance connected in series with the selected receiver through the switching gates 1011 to 1016. The voltage obtained from the path 1003 depends on the values of the external resistor under measurement and the resistance of the gate 1031 to 1033 selected. Successively switching the gated resistors 1031 to 1033 changes the voltage 1003 until it hits the threshold level. Successive approximation technique well known in the art can be used to quickly adjusting the voltage divider to get close to the threshold level. Because precision resistances of the gates 1031 to 1033 may be difficult due to variation of IC fabrication process, external reference resistors 1051 to 1053 and selection gates 1061 to 1063 are provided for performing the calibration process as previously discussed. It should be noted that the voltage at path 1003 can be fed to an A/D converter instead of using a successive approximation approach.

Figure 11:
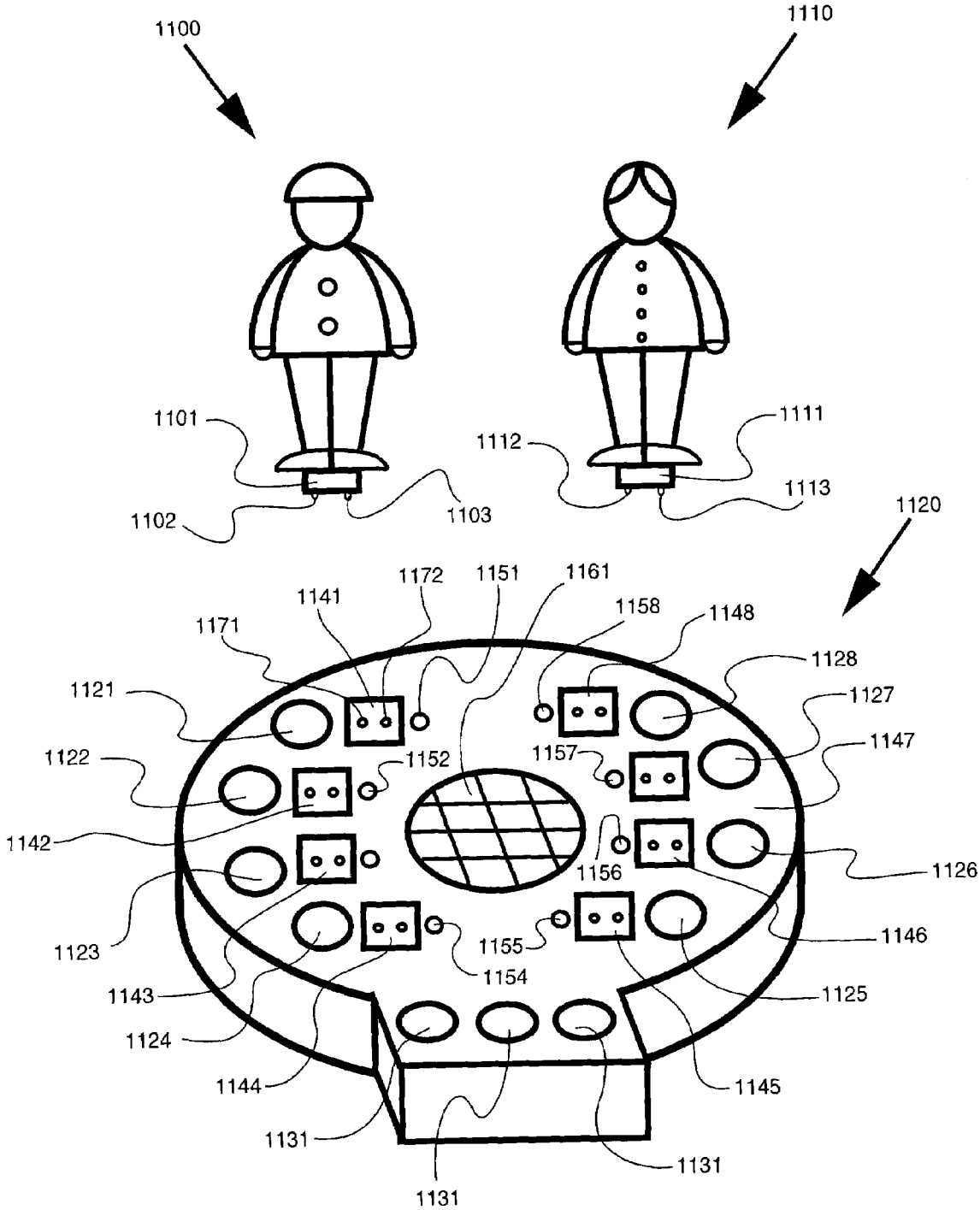
FIG. 11 demonstrates an alternate toy play set embodiment having different sets of accessory toy figures.

FIG. 11 depicts another preferred embodiment of the game play set. The toy play set comprises a master toy member 1120 and multiple accessory members 1100 and 1110, each represented by a toy figure. The master member 1120 is in the shape of a game board that comprises control buttons 1131; output indicators 1151 to 1158; input trigger buttons 1121 to 1128 and receivers 1141 to 1148. Receiver 1141 is provided with at least two contact pins 1171 and 1172. Each of the receivers is supported with a corresponding input trigger button and an output indicator. The master toy unit is also equipped with a speaker 1161 for providing messages, instructions, questions, and sound effects to support the game play. The play set also includes two or more accessory toy members, which are sold separately or included with the master member. It is up to the toy designers to define the different game rules for the accessory toy members to interact with the users. In an explanatory embodiment, accessory toy FIG. 1110 is given a name Jack, he is a farmer, he likes eating vegetables, and his favorable color is brown, other information about Jack and his family is also announced. The FIG. 1110 represents a teacher whose name is Jill. When Jack or Jill is connected with anyone of the receivers 1141 to 1148, a resume about each character is announced through the speaker 1161 or displayed through a LCD panel. In order for the master member 1120 to recognize the character connected with a receiver, an identity component of unique value is embedded inside the figure of each accessory toy members. In a preferred embodiment, this identity component is represented by a resistor of unique resistance value. The master toy member 1120 identifies the resistance inside each character or toy figure and provides interactive responses according to the game rule. Audio response is provided by the speaker 1161, visual response can be provided by an animated motor or other visual output devices such as the LED indicators 1151 to 1158, or a LCD display panel. After the master toy member 1120 announces the background information of each connected accessory toy members, the master toy member 1120 starts to ask question about each accessory toy members. For example, the master toy member may ask: "Who likes eating vegetables?" by voice or by visual display. The user is prompted to select one of the characters lined up on the game board of the master toy member by pressing the input switch of the switch array 1121 to 1128, each corresponds to a receiver on the master toy unit. Score adds up when the user enters correct selections. The game rule of the play set may be modified during game play. The master toy member may announce that Jill changed her job to be an accountant, and John changed his favorable color. The game rule may allow the user to modify the line up sequence of the accessory toy members or to replace one toy figure with a new toy figure. In an alternate game rule, the master toy member sequentially light up the LEDs 1151 to 1158. The lighting sequence gradually slows down and stop next one of the character. The master toy member then asks a question and gives three possible answers. The user selects one of the three selection buttons 1131. This toy play set trains the user to remember background information about people. As compared with tradition prior art board games based on pictures, this play set trained small children to remember information provided by voice messages, and to recognize three dimensional characters according to their physical look.

The embodiments of FIGS. 1 and 11 disclosed game play set making use of a master toy member and a family of accessory toy members or toy figures. Each accessory toy member is equipped with an identity component to identify its unique characteristics or personality. Preferred identity component is a commodity resistor. Input device such as trigger buttons are provided for the user to identify or select one of the accessory toy members. In a preferred embodiment, each receiver is provided a corresponding input devices for the user to selected the accessory toy member connected to the said receiver. Multiple accessory toy members can be connected with the master toy member at the same time. The play set is designed to consume low operation and standby current. Different game play set can be invented by providing different look of the master and accessory toy members, and defined by different game rules. In addition to the memory game described, his game play set design is particularly useful for many other different toy and game designs. For example, set up of FIG. 11 can be configured to provide a male action strategy game. The FIGS. 1100 and 1110 can be in the shape of male action toy figures and the master toy member 1120 containing the main electronics circuit becomes a housing decorated as a battlefield. Action toy figures of two different combating teams are line up on the battlefield. The combat result depends on the strategic sequence of the line up and the internal power and personality of each action toy figures.

Figure 12:
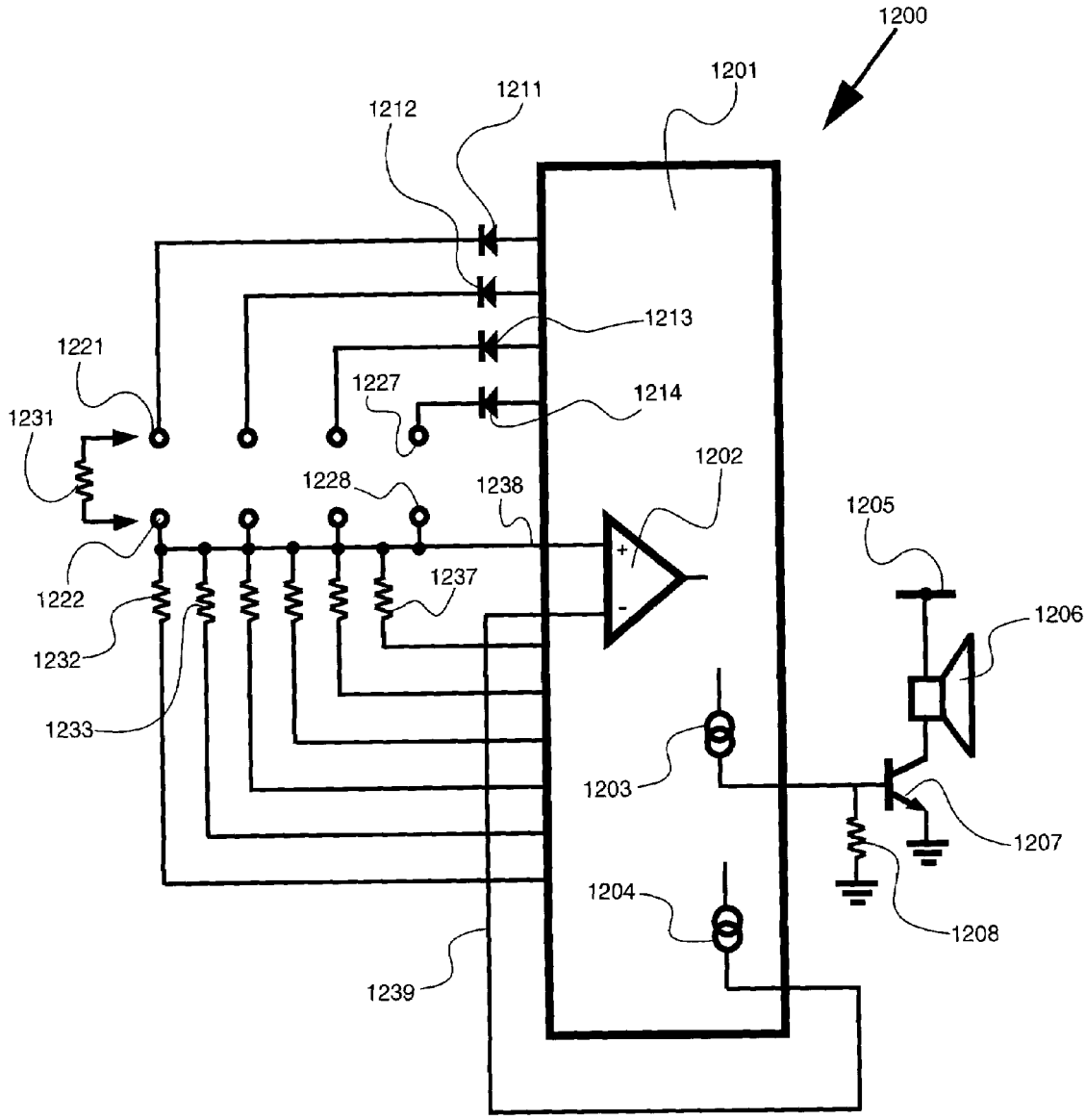
FIG. 12 illustrates an alternate three dimensional resistors identification circuit having a comparator built inside the microcontroller.

Attention is now directed to FIG. 12, which discloses an alternate embodiment to detect multiple external resistors. Microcontroller 1201 is a dual channel voice chip, which provides two D/A output channels 1203 and 1204. The circuit is further supported by a comparator 1202, which can be embedded inside the microcontroller or positioned outside the microcontroller. The first output channel is connected to a speaker circuit for generating voice and sound signals. Instead of connecting the second audio channel to drive another speaker, this channel is connected to an input terminal of a comparator. An array of high precision reference resistors 1232 to 1237 are provided to compare with the value of an external resistor 1231 connected to anyone of the receivers through the contact pins 1221, 1222 or 1227, 1228. Output pins of the microcontroller 1201 direct a voltage to each of the receivers through the diodes 1211 to 1214. The circuit shared a single comparator 1202 and therefore only one of the receivers is activated at a time. The diodes 1211 to 1214 isolate a receiver circuit when the output logic is at low level. If the output pin of the microcontroller is capable of providing a high impedance output state, the diodes 1211 to 1214 can be eliminated. In order to service a wide range of resistance values, the output pin of a commodity microcontroller may not be able to source a high current for detecting low impedance resistors in the range less than 820 ohm, then a switching transistor driver is required to replace each of the diodes 1211 to 1214.

Figure 13:
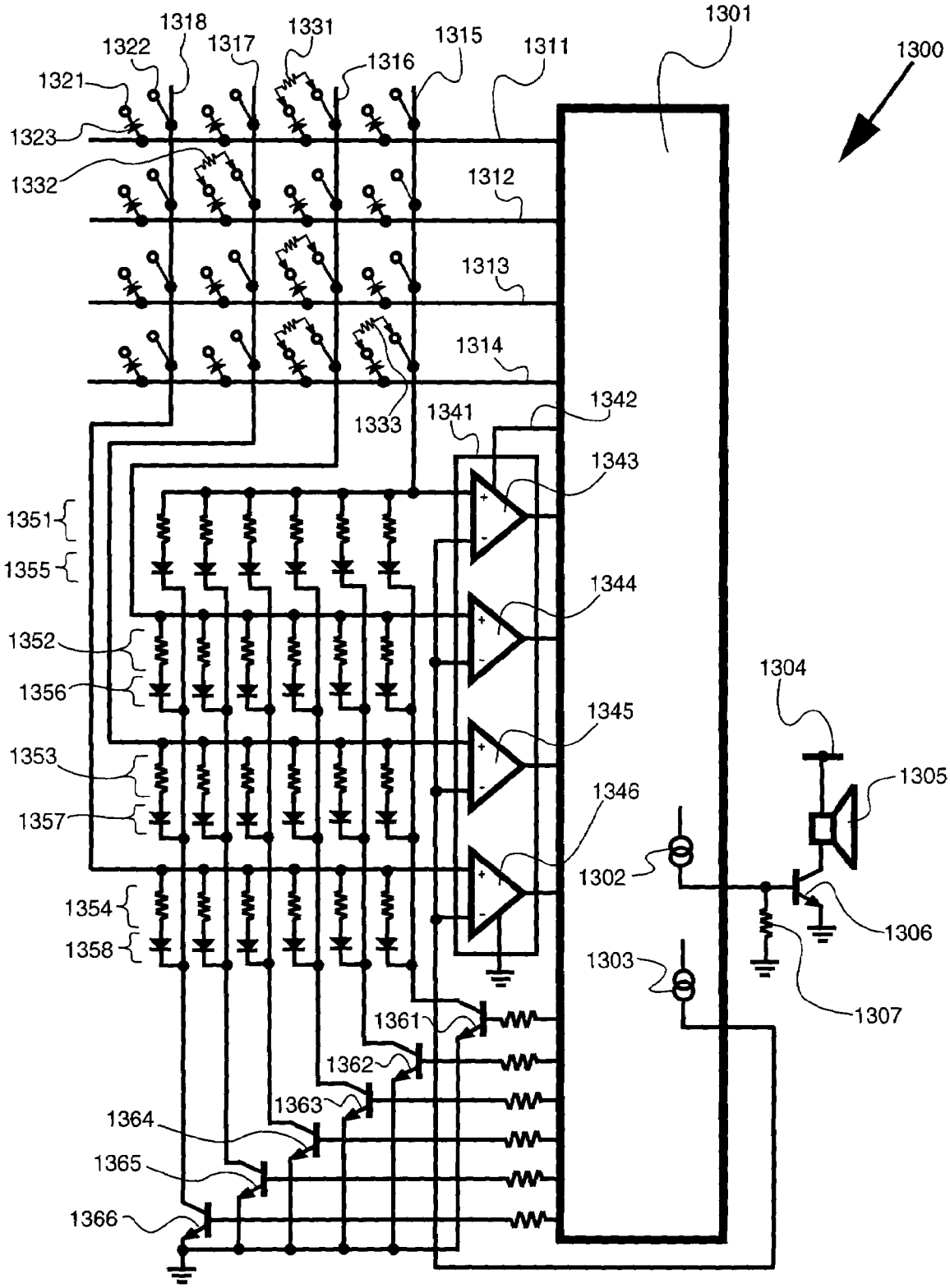
FIG. 13 illustrates a four dimensional resistors identification circuit having an array of external comparators connected to a D/A converter embedded inside a microcontroller.

FIG. 13 is the four dimensional version of the FIG. 12 circuit design. Two of the dimensions are defined by the 4×4 array of receivers formed by the columns 1315 to 1318 and the rows 1311 to 1314. The row lines are controlled the output pins of microcontroller 1301. The column line 1315 is connected to an array of reference resistors 1351 and the input pin of the comparator 1343. Similarly each of the other column lines is connected to an independent array of reference resistors and a comparator. The series diodes 1323 of the receivers enable different external resistors to be connected to different receivers at the same time without affecting the resistance identification process. The switching transistors 1361 to 1366, controlled by the microcontroller 1301 turn on and off each group of reference resistors. For example, the switching transistor 1361 may be configured to turn on the four reference resistors of 100 ohm value, enabling the identification circuit to detect external resistors close to the 100 ohm resistance range. The switching transistor 1366 is configured to turn on the four reference resistors of 500 kohm value allowing the circuit to measure external resistors in the range higher than 100 kohms. The diodes arrays 1355 to 1357 ensure the reference resistors are disconnected from the comparator circuit when a switching transistor is turned off. If the output pins of the microcontroller provide adequate current sinking capability, the interfacing transistors 1361 to 166 may not be required.

During the measurement process to identify the resistance of resistor 1333, the output line 1314 is turned high to provide a current to flow through the resistor 1333 and the reference resistors 1351 beneath. The switching transistors 1361 to 1366 are turned on one by one to select one of the arrays of resistors connected to the input circuit of the comparator 1343. The output of the comparator 1343 is monitored to see which reference resistor is of closest range to the external resistor 1333. Each member of the arrays of diodes 1355, 1356, 1357 and 1358, is connected in series with a reference resistor. This circuit design enables the same value resistor of each array of reference resistors to be turned on at the same time. When the closest reference resistor is identified, the D/A converter 1303 of the microcontroller 1301 successively provides a feedback reference voltage to compare with the input voltage formed by the potential divider of the external resistance 1333 and the selected reference resistor of the array 1351 selected. The microcontroller successively changes the value of the reference voltage derived from the source 1303 until the exact input potential dividing voltage is detected. The digital value provided to the internal D/A converter at this time represents the unique resistance of the external resistor 1333, and also the personality of the accessory toy member or figure that holds the external resistor 1333. The microcontroller 1301 then provides responses according to the unique value of the resistors 1333 detected. Additional comparators 1344, 1345, 1346 and additional arrays of reference resistors 1352, 1353, 1354 support the additional columns of receivers 1316, 1317, 1318 and speed up the multiple external resistors identification process. Audio responses are provided through another D/A converter which converts internal digital data into audio signal to drive the electricity to sound transducer 1305 through the transistor 1306. Visual responses can be provided by other output pins of the microcontroller 1301 not shown in the circuit. If more D/A converters are available, each comparator of the array 1341 can be connected with a different D/A converter to provide a more efficient multitask identification process.

Since most external comparator array is a circuit component that continuously consumes power, in order to conserve the power of the battery operated toy play set, it is preferable to control the power supply of the comparator by another output pin 1342 of the microcontroller 1301. Output pin 1342 can be connected directly to the power supply line of comparator IC 1341 or through a driving transistor depends on the current capability of the out pin.

From the foregoing, it should now be appreciated that the applicant has disclosed herein embodiments of an electronics circuit designed for a matrix array of receivers configured to detect multiple high resolution external resistors selected from the 100 ohm to 1 Mohm range, and to provide different responses according to the resistance of a resistor connected to a receiver. Particularly, it should be noted that there are different variations of contact designs, different ways to measure resistor values and different arrangements to calibrate the measurement circuits. It should also be noted that the different unique features of the illustrated embodiment can be enhanced, reduced or simplified to meet the different application needs, which are not limited to toy applications. Although detailed embodiments of the invention have been disclosed, it is recognized that variations and modifications, all within the spirit of the invention, will occur to those skilled in the art. It is accordingly intended that all such variations and modifications be encompassed by the appended claims.

What is claimed is:

1. An electronics circuit providing an array of receivers to identify the resistance values of external resistors, said electronics circuit comprising:

an array of receivers each comprises at least two connecting pins;

an array of reference resistors;

at least one comparator;

a microcontroller having a first and second arrays of interface pins; wherein each of said first array of interface pins is connected to one of said receivers;

each of said second array of interface pin is connected to turn on one of said reference resistors;

said microcontroller is further configured to provide a feedback signal to said comparator; and said electronics circuit is also configured to provide data for identifying said external resistors.

2. The electronics circuit of claim 1 wherein the power consumption of said comparator is controlled by said microcontroller.

3. The electronics circuit of claim 1 wherein a connecting pin of one of said receivers is connected to one of said reference resistors and also to an input pin of said comparator.

4. The electronics circuit of claim 1 wherein at least one of said receivers is connected in series with a diode.

5. The electronics circuit of claim 1 wherein said comparator is embedded inside said microcontroller.

6. The electronics circuit of claim 1 wherein said microcontroller further comprising at least a first and a second digital to analog converters; wherein said first embedded digital to analog converter is configured to provide audio signals and said second embedded digital to analog converter is configured to provide feedback signals to said comparator.

7. The electronics circuit of claim 1 further comprising a second comparator and a second array of reference resistors; wherein the input circuit of each comparator comprises an array of reference resistors.

8. The electronics circuit of claim 1 wherein said microcontroller is configured to control turning on and off said reference resistors.

9. The electronics circuit of claim 8 wherein a transistor is connected to turn on or off one of said reference resistors.

10. The electronics circuit of claim 1 wherein said microcontroller provides a response in accordance to the resistance value of an external resistor connected to one of said receivers.

11. The electronics circuit of claim 10 wherein said response is an audio signal.

12. The electronics circuit of claim 1 wherein at least one of said reference resistors is connected in series with a diode.

13. The electronics circuit of claim 1 further comprising a housing to form the master member of a play set, wherein said play set further comprises at least a first and a second accessory members each identified by a resistor of different value.

14. The electronics circuit of claim 13 wherein said master member comprises a game board.

15. The electronics circuit of claim 13 wherein each of said first and second accessory members represents a motor vehicle.

16. The electronics circuit of claim 13 wherein each of said first and second accessory member represents a toy figure.

17. An electronics circuit providing an array of receivers to identify the resistance values of external resistors, said electronics circuit comprising:

an array of receivers each comprises at least two connecting pins; at least one of said receivers is connected in series with a diode;

a microcontroller; wherein said electronics circuit is configured to provide data for identifying an external resistor connected to one of said receivers; and said microcontroller is further configured to provide a response in accordance to the value of said external resistor identified.

18. The electronics circuit of claim 17 wherein said microcontroller and said receivers are structured to define a master toy member and each of said external resistors forms part of an accessory toy member.

19. An electronics circuit providing an array of receivers to identify the resistance values of external resistors, said electronics circuit comprising:

an array of receivers each comprises at least two connecting pins;

at least one comparator;

a microcontroller; wherein said electronics circuit is further configured to provide data for identifying an external resistor connected with one of said receivers;

said microcontroller is also configured to provide a response in accordance to the value of said external resistor identified; and the power consumption of said comparator is configured to be controlled by said microcontroller.

20. The electronics circuit of claim 19 wherein said microcontroller, said comparator and said receivers are structured to define a master toy member and each of said external resistors forms part of an accessory toy member.

21. An electronics circuit providing an array of receivers to identify the resistance values of external resistors, said electronics circuit comprising:

an array of receivers each comprises at least two connecting pins;

at least one comparator;

an array of reference resistors;

a microcontroller; wherein said electronics circuit is configured to provide data for identifying an external resistor connected with one of said receivers;

said microcontroller is also configured to provide a response in accordance to the value of said external resistor identified; and said microcontroller is further configured to turn on and off each of said reference resistors.

22. The electronics circuit of claim 21 wherein said microcontroller, said comparator and said receivers are structured to define a master toy member and each of said external resistors forms part of an accessory toy member.

23. An electronics circuit providing an array of receivers to identify the resistance values of external resistors, said electronics circuit comprising:

an array of receivers each comprises at least two connecting pins;

an array of comparators;

an array of reference resistors;

a microcontroller;

said electronics circuit is configured to provide data for identifying an external resistor connected one of said receivers; said microcontroller is also configured to provide a response in accordance to the value of said external resistor identified, wherein one pin of a receiver is controlled by an output pin of said microcontroller and the other pin of said receiver is connected to provide a voltage to an input pin of a comparator.

24. The electronics circuit of claim 23 wherein said microcontroller, said comparator and said receivers are structured to define a master toy member and each of said external resistors forms part of an accessory toy member.

* * * * *